US011365517B2

(12) United States Patent
Hietaniemi

(10) Patent No.: US 11,365,517 B2
(45) Date of Patent: Jun. 21, 2022

(54) METHOD FOR MANUFACTURING A MULTI-LAYERED PAPERBOARD, MULTI-LAYERED PAPERBOARD AND COMPOSITION FOR USE IN MULTI-LAYERED PAPERBOARD MANUFACTURING

(71) Applicant: Kemira Oyj, Helsinki (FI)

(72) Inventor: Matti Hietaniemi, Espoo (FI)

(73) Assignee: Kemira Oyj, Helsinki (FI)

( * ) Notice: Subject to any disclaimer, the term of this patent is extended or adjusted under 35 U.S.C. 154(b) by 0 days.

(21) Appl. No.: 16/975,729

(22) PCT Filed: Jan. 18, 2019

(86) PCT No.: PCT/FI2019/050037

§ 371 (c)(1),
(2) Date: Aug. 26, 2020

(87) PCT Pub. No.: WO2019/180303

PCT Pub. Date: Sep. 26, 2019

(65) Prior Publication Data

US 2021/0002830 A1 Jan. 7, 2021

(30) Foreign Application Priority Data

Mar. 22, 2018 (FI) ..... 20185269

(51) Int. Cl.

| | |
|---|---|
| ***D21H 27/36*** | (2006.01) |
| ***D21F 11/04*** | (2006.01) |
| ***D21H 17/26*** | (2006.01) |
| ***D21H 17/29*** | (2006.01) |
| ***D21H 17/42*** | (2006.01) |
| ***D21H 17/45*** | (2006.01) |
| ***D21H 21/18*** | (2006.01) |
| ***D21H 23/28*** | (2006.01) |
| ***D21H 23/50*** | (2006.01) |
| ***D21H 23/72*** | (2006.01) |

(52) U.S. Cl.

CPC ..... *D21H 27/36* (2013.01); *D21F 11/04* (2013.01); *D21H 17/26* (2013.01); *D21H 17/29* (2013.01); *D21H 17/42* (2013.01); *D21H 17/45* (2013.01); *D21H 21/18* (2013.01); *D21H 23/28* (2013.01); *D21H 23/50* (2013.01); *D21H 23/72* (2013.01)

(58) Field of Classification Search

USPC ..... 162/124

See application file for complete search history.

(56) References Cited

U.S. PATENT DOCUMENTS

| | | | |
|---|---|---|---|
| 5,935,383 | A | 8/1999 | Sun et al. |
| 2003/0155071 | A1 | 8/2003 | Werres et al. |

FOREIGN PATENT DOCUMENTS

| | | | |
|---|---|---|---|
| JP | S61113896 | A | 5/1986 |
| JP | S62257498 | A | 11/1987 |
| JP | H0833000 | B2 | 3/1996 |
| JP | 3301191 | B2 | 7/2002 |
| JP | 2002294595 | A | 10/2002 |
| JP | 3551213 | B2 | 8/2004 |
| WO | 2005042843 | A1 | 5/2005 |
| WO | 2006120235 | A1 | 11/2006 |
| WO | 2012042115 | A1 | 4/2012 |
| WO | 2014072587 | A1 | 5/2014 |
| WO | 2015036932 | A1 | 3/2015 |
| WO | 2016034776 | A1 | 3/2016 |

OTHER PUBLICATIONS

JP 3551213,B, Nagata et al., Arakawa Chemical Ind., machine translation, Aug. 2004.*

Dry strength enhancement of paper and board by wet-end addition of restructured, granular starch (2009). [available on online server on Aug. 16, 2017] [retrieved on Sep. 13, 2018]. Retrieved from <https://www.ptspaper.com/fileadmin/PTS/PTSPAPER/06_Forschung/Dokumente/Forschungsprojekte/AiF_15174KBe.pdf> p. 1, lines 10-11.

Acosta-Osorio, A. et al. Analysis of the Apparent Viscosity of Starch in Aqueous Suspension within Agitation and Temperature by Using Rapid Visco Analyzer System, In: Mechanical Engineering Research Dec. 31, 2011, vol. 1, No. 1, 110-124, ISSN 1927-0607, <DOI:10.5539/mer.v1n1p110> p. 119, table2, p. 123, figure 8.

Gruber, E. et al. Modified granular starches for wet end application. In: EUCEPA symposium 1998—chemistry in papermaking, 1998, pp. 378-391. p. 379, p. 380, lines 14-18.

Office action of counterpart Chinese application 201980015085.1 dated Mar. 3, 2022, 12 pages.

* cited by examiner

*Primary Examiner* — Mark Halpern

(74) *Attorney, Agent, or Firm* — Meunier Carlin & Curfman LLC

(57) ABSTRACT

A method for manufacturing a multi-layered paperboard is disclosed, which includes at least two fibrous layers, in which method at least one layer of the multi-layered paperboard is treated by applying an aqueous solution of a first strength component in dissolved form including anionic strength polymer and/or amphoteric strength polymer composition on a surface of layer, and an aqueous solution of a cationic second strength component in dissolved form is added to a fibre stock from which at least one of the fibrous layers joined together is formed.

15 Claims, 1 Drawing Sheet

METHOD FOR MANUFACTURING A MULTI-LAYERED PAPERBOARD, MULTI-LAYERED PAPERBOARD AND COMPOSITION FOR USE IN MULTI-LAYERED PAPERBOARD MANUFACTURING

PRIORITY

This application is a U.S. national application of the international application number PCT/FI2019/050037 filed on Jan. 18, 2019 and claiming priority of FI application number 20185269 filed on Mar. 22, 2018 the contents of all of which are incorporated herein by reference.

FIELD OF THE INVENTION

The present invention relates to a method for manufacturing a multi-layered paperboard and a multi-layered paperboard according to the preambles of the independent claims presented below. The invention relates also to an aqueous composition for improving z-directional tensile strength of a multi-layered paperboard.

BACKGROUND OF THE INVENTION

Multi-layered or multi-ply paperboard comprises at least two layers which are joined together during manufacturing. The advantages of the multi-layered board construct lie in the ability to optimize e.g. fibre characteristics in the different layers to reach certain functionalities. This may be done e.g. by varying the content and quality of the fibre stock in each layer.

The internal bond strength, represented typically by z-directional tensile strength, is important factor for multi-layered paperboard, since it determines e.g. board's processability during printing and/or after coating, and performance in different end-uses. The internal bond strength of a multi-layered paperboard may be affected by the inherent strength of the fibres used in each layer or ply, and the capability of the fibres to form strong fibre-fibre bonds. Inherent strength decreases after each recycling of the fibres, while ability to form strong fibre-fibre bonds is additionally affected by level of refining. The internal bond strength of a multi-layered paperboard is also affected by the ply bond, i.e. the strength of the bonding of the fibrous layers to each other. One problem associated with methods for manufacturing multi-layered paperboards is that the ply bond may not be sufficient, thereby decreasing the internal bond strength of the whole multi-layered paperboard. This may be observed e.g. in offset printing as delamination of the multi-layered paperboard when subjected to the Z-directional force caused by the peeling of the sheet from a press blanket containing tacky ink. Similarly, z-directional forces applied during coating or lamination processes of multi-layered paperboards having insufficient internal bond strength may lead to delamination of the layers. Also, certain end-uses of the multi-layered paperboards may require specifications that depend directly or indirectly on board's internal bond strength. For example, the multi-layered paperboard must have elevated internal bond strength in order that a core board performs well. As such, a need currently exists for an improved method of manufacturing a multi-layered paperboard having sufficient internal bond strength throughout the multi-layered structure, especially between the layers of the multi-layered paperboard.

Water, and optionally granular starch, may be applied on the surfaces of the inner layers for improving internal bond strength between the layers of the paperboard. Application of water may only assist in maintaining layer's existing potential to form bonds with the adjacent layer surfaces when joined by increasing the amount of free water present, but it does not increase strength beyond that. Granular starch applied on the surface(s) of inner layers, commonly by spraying, gelatinizes when kept for a prolonged time at elevated temperature at the drying section, making it capable to form hydrogen bonds with the fibres of the adjacent layers. However, the delay and the high temperature require increased drying capacity and slower machine speed, which are not desired from the view of the efficiency and the costs of the multi-layered paperboard manufacturing.

SUMMARY OF THE INVENTION

It is an object of the present invention to reduce or even eliminate the above-mentioned problems appearing in prior art.

An object of the invention is to provide a method, which enables production of multi-layered paperboard with improved z-directional tensile strength and reducing the risk of delamination of the multi-layered board.

A further object of the present invention is to provide an aqueous composition for improving z-directional tensile strength of a multi-layered paperboard which can be easily applied on a surface of the wet fibrous web.

In order to achieve among others the objects presented above, the invention is characterized by what is presented in the characterizing parts of the enclosed independent claims.

Some preferred embodiments of the invention will be described in the other claims.

The embodiments and advantages mentioned in this text relate, where applicable, both to the method, the composition and the paperboard as well as to the uses according to the invention, even though it is not always specifically mentioned.

A typical method according to the invention relates to a manufacturing of a multi-layered paperboard, which comprises at least two fibrous layers, and which layers are formed by multiple separate forming units, wherein at least part of water is drained from at least one fibrous layer, the layers are joined together, and the joined layers are subjected to further draining, wet-pressing and drying for obtaining the multi-layered paperboard product. In a typical method according to the invention at least one fibrous layer of the multi-layered paperboard is treated by applying an aqueous solution of a first strength component in dissolved form comprising anionic strength polymer and/or amphoteric strength polymer composition on a surface of the layer, which surface is arranged to be in contact with another layer of the multi-layered paperboard to be produced, prior to joining the layers together, and an aqueous solution of a cationic second strength component in dissolved form is added to the fibre stock from which at least one of the fibrous layers joined together is formed.

A typical multi-layered paperboard according to the present invention comprises at least two fibrous layers and is produced by using a method according to the present invention.

A typical aqueous composition for improving z-directional tensile strength of a multi-layered paperboard has a viscosity of below 100 mPas, preferably 1.4-100 mPas, and more preferably 1.4-50 mPas measured by Brookfield LV DV1 viscometer with small sample adapter using maximum rpm allowed by the equipment, instantly after mixing, at prevailing temperature and solids content at the application time, and the composition comprises a first strength component in dissolved form comprising anionic strength polymer and/or amphoteric strength polymer composition, and granular starch, preferably granular non-ionic, non-degraded or non-degraded non-ionic starch, wherein the weight ratio of the first strength component to granular starch is 0.02:1 to 3:1 (dry/dry), preferably 0.05:1 to 0.9:1 (dry/dry), and more preferably 0.1:1-0.4:1 (dry/dry).

An aqueous composition according to the present invention is preferably used for improving z-directional tensile strength of a multi-layered paperboard by applying, prior to joining the fibrous layers together, an aqueous solution of the composition on a surface of at least one fibrous layer having a dryness of 0.5-25%, preferably 1.5-20% and more preferably 2-18%, and which surface is arranged to be in contact with a surface of another fibrous layer of the multi-layered paperboard to be produced, upon joining the layers.

Now, it has been found that internal bond strength, represented typically by z-directional tensile strength, of the multi-layered paperboard may be improved when applying a first strength component comprising anionic strength polymer and/or amphoteric strength polymer composition on a surface of at least one fibrous layer on a wire section when the dryness of the layer, to which the first strength component is applied, is typically in the range of 0.5-25%, and which surface is arranged to be in contact with a surface of another fibrous layer of the multi-layered paperboard to be produced, i.e. the treated surface resides inside the final multi-layered board product. In addition to the first strength component comprising anionic strength polymer and/or amphoteric strength polymer composition, the cationic second strength component is also introduced to the manufacturing process of the multi-layered paperboard. According to the present invention, a cationic second strength component is introduced by adding an aqueous solution of a cationic second strength component in dissolved form to the fibre stock from which at least one of the fibrous layers joined together is formed. In one preferred embodiment a cationic second strength component is added to the fibre stock from which is formed fibrous layer to be further treated with the first strength component. According to the present invention, both anionic and cationic charges are introduced to the fibrous layer(s), and so an improved internal bond strength may be provided. Especially, when the first strength component applied on the surface of the fibrous layer comprises both cationic and anionic charges, penetration of the first strength component to the fibrous layers may be further hindered, so it remains better on the surfaces of the fibrous layers, or the bond line of the joined layers, and provides a further improved internal bond strength.

The present invention is developed to the manufacturing of a multi-layered paperboard from fibre stock(s) comprising papermaking fibres, and in which method at least first fibrous layer and second fibrous layer are formed by first wire forming unit and second wire forming unit and at least part of water is drained on a wire section from at least one layer, after draining on wire section the formed fibrous layers are joined together and the joined fibrous layers are subjected to further draining, wet-pressing and drying to form the multi-layered board product. The manufacturing of the fibrous layers by using separate forming units enables application of a first strength component on a surface of at least one layer, which surface is in contact with other layer of the final multi-layered paperboard, prior to joining the layers. Thus, the first strength component can be applied on the inner surfaces of the multi-layered paperboard.

A method according to the present invention especially provides improved z-directional tensile strength of a multi-layered paperboard comprising at least two fibrous layers. The z-directional tensile strength is defined as force required to produce unit area fracture perpendicular to the plane of board (kPa). By using the method according to the invention also any of the following may be improved separately or simultaneously: burst strength, IGT dry pick (surface strength), Dennison wax test, Scott bond, tensile strength in machine direction (MD) and cross direction (CD), compression strength measured by Short-Span Compressive Test (SCT), Concora medium test (CMT) value for fluting, Ring crush test (RCT) value for liner, and bending stiffness.

According to the present invention a multi-layered paperboard may be any multi-layered paperboard, which comprises at least two fibrous layers and is produced by using a method according to the present invention. The invention is particularly advantageously implemented when forming folding boxboard, liquid packaging board, white top liner, kraft liner, test liner, fluting board, chipboard, core board, cupboard, or white lined chipboard. Typical multi-layered paperboards such as folding boxboard (FBB), liquid packaging board and white lined chipboard (WLCB) require good ply bond measured as Scott bond or z-directional tensile strength or IGT dry pick or Dennison wax test and bending stiffness, and so the present invention is suitable for these boards. Liners, e.g. multiply test liners with layers of short fibre fraction and long fibre fraction, and multiply fluting boards, require SCT, burst, CMT and RCT strength. In commonly used methods, these grades are treated with surface sizing composition applied with a size-press on a multi-layered fibre web having dryness of at least 60% to give burst strength. However, the surface sizing starch applied with size-press does not penetrate evenly throughout the board thickness and so the centre structure of the multi-layered paperboard remains weaker. With the present invention, especially the centre structure of the multi-layered paperboard can be strengthened since the first strength component is applied on the surface of the wet fibre layer or web on wire section and so ion bond formation with the cationic second strength component may start already in wire section and the strength components are fixed to the fibrous layer.

For white top liners having thin bleached top layer and thicker brown (recycled fibre and/or unbleached) back layer, it is important to obtain strength to the centre structure, as measured e.g. by Scott bond, to improve printability. Also, for core board having high thickness, good Scott bond is important. Typically, high dosages of granular starch are applied between the layers requiring lower machine speeds so that all the granular starch is gelatinized at drying section for making it capable of forming hydrogen bonds and providing strength. In the present invention ion bonds are formed that do not require the longer drying time in order to provide the strength effect. Therefore, the method according to the present invention also provides higher machine speeds.

As the present invention applies treatment with the first strength component between the layers of the multi-layered paperboard structure, the consumption of the strength components needed for desired strength level is lower compared to treatment of the whole fibre stock of one or more of the layers. Additionally, weaker fibre qualities such as recycled fibres or less refined fibres can be used in the layers without compromising the strength of the final multi-layered paperboard.

Especially, the method according to the invention is beneficial for manufacturing of multi-layered paperboard grades to be printed. The printability of the boards may improve since internal strength between the layers is better and the risk of layers slitting during printing is reduced.

The present invention improves internal bond strength between the layers of the multi-layered paperboard, and so it has also been observed that a method according to the present invention enables a use of the fibres with lower refining degree which improves dewatering of the multi-layered web, and also runnability of the machine may be improved.

DESCRIPTION OF THE DRAWINGS

The invention will be described in more detail with reference to appended drawings, in which.

DETAILED DESCRIPTION OF THE INVENTION

Figure 1:
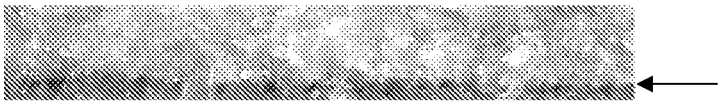
FIG. 1 is a microscope image of a multi-layered fibre web where an aqueous composition according to the invention has been applied between the layers.

In the present invention description, the terms "a multi-layered paperboard", "a multi-layered board" and "a multi-ply board" refers to a multi-layered paperboard product comprises at least two fibrous layers. A number of the layers of the multi-layered paperboard is not limited, but the method according to the invention is applicable for all kind of the multi-layered paperboard structures irrespective of the number and quality of the layers.

In a typical embodiment of the present application, a multi-layered or multi-ply board is typically manufactured from fibrous webs formed by multiple separate forming units, wherein each of the wet fibrous web, i.e. fibrous layer, is formed from a fibre stock by using own forming unit and at least part of water is drained on a wire section, and the formed fibrous webs are joined together and the joined fibrous webs are subjected to further draining, wet-pressing and drying for obtaining the multi-layered paperboard product. The forming unit refers to any arrangement which may be used to form wet fibrous web from fibrous stock, and with which arrangement separate wet fibrous webs are first formed on the wire or the like and in the later stage the separate at least partly drained fibrous webs are joined to multi-layered web. The forming unit may comprise a head box or a cylinder former. According to an embodiment of the invention, at least a first wet fibrous web and a second wet fibrous web are formed by using a first head box and a second head box and the formed fibrous webs are joined together for obtaining the multi-layered fibrous web. Multi-layered paperboard may contain a different kind of fibre stock in each layer, and so fibrous webs of the multi-layered paperboard may be formed from separate fibre stocks or the same fibre stock may be fed to several head boxes. One or more layers of the multi-layered paperboard product may be also formed by using multilayer headbox, wherein the obtained multi-layered web(s) can be used as one fibrous layer of the multi-layered board according to the present invention. Multilayer headbox is not a system of multiple separate forming units, as meant in the invention.

According to an embodiment of the invention, one or more layers of the multi-layered paperboard may also be formed by using forming units so that the fibrous layer is a lip flow of headbox or a jet of headbox. Therefore, one layer of the multi-layered paperboard may be manufactured from fibrous web formed by forming unit, wherein fibrous web or layer is formed from a fibre stock and at least part of water is drained on a wire section from it, and then another fibrous layer is applied on the surface of the at least partly drained fibrous web and the joined fibrous layers are subjected to further draining, wet-pressing and drying for obtaining the multi-layered paperboard product. Another fibrous layer applied on the surface of the first layer is not necessarily subjected to the draining prior to joining.

According to one embodiment of the invention, a first strength component comprising anionic strength polymer and/or amphoteric strength polymer composition is applied on a surface of the wet fibrous layer when the dryness of the fibrous layer or web is <25% or <20%. According to one preferred embodiment of the invention the aqueous solution of the first strength component comprising anionic strength polymer and/or amphoteric strength polymer composition is applied on a surface of at least one wet fibrous layer or web on a wire section, when the dryness of the fibrous layer is 0.5-25%, preferably 1.5-20%, more preferably 2-18% and even more preferably 10-15%, and which surface is arranged to be in contact with a surface of another fibrous layer of the multi-layered paperboard to be produced. The dryness of another fibrous layer web, with which the treated fibrous layer is joined, may differ from the dryness of the fibrous layer to be treated with the first strength component, i.e. the wet fibrous layer may be joined together in different dryness values or another fibrous layer is not subjected to the draining at all. The above-mentioned dryness values are especially disclosed to the fibrous layer to be treated with the first strength component, but typically the dryness of the all wet fibrous layer may be in the range defined above. When the fibre stock enters the headbox, its dryness level is typically more or equal to 0.3% and less than 2%. The first water removal from the fibrous layer or web is conducted when the fibrous web enters the wire section from the headbox. The process of water removal on the wire section is accomplished in number of stages. The physical mechanism of removing water in each of the stages may be different. For example, water removal may be conducted by gravity, pressure pulses, g-forces or vacuum filtration. There are a number of different dewatering elements and arrangements available to conduct water removal on the wire section, such as foils, rolls, suction boxes, loadable plates, etc. The method according to the invention is applicable to be used with all kind of the water removal elements and arrangements. After the wire section, the dryness of the fibrous web or layer is typically 14-22%. Typically, the dryness of fibrous web further increases to 40-55% during wet pressing. The applying of the first strength component on a surface of the fibrous web or layer is preferably conducted on the wire section, preferably by spraying. According to the present invention, a first strength component may be applied immediately after the head box when the fibrous layer has formed. Primarily the ply bond strength is contributed by formation of fibre-fibre hydrogen bonds, so it is advantageous to join the fibrous layers and therefor to apply the first strength component when dryness of the layer is at most 25%, i.e. when the fibres still have sufficient capability to form hydrogen bonds. It is also advantageous that the dryness is sufficiently high so that the wet layers are not damaged when they are joined together. Most preferably, the first strength component is applied on a surface of the wet fibrous layer, when the dryness of the fibrous layer is about 10-15%, then the leaching of the first strength component with the removed water can be reduced most efficiently and the first strength component may remain close to the bond line of the joined layer.

According to the typical embodiment of the invention, the presented method utilizes multiple separate forming units and then the application of a first strength component comprising anionic strength polymer and/or amphoteric strength polymer composition on a surface of at least one wet fibrous layer, which surface is in contact with another layer in the final multi-layered paperboard, is possible prior to joining the fibrous layers. Therefore, after at least one wet fibrous layer is formed, and preferably at least partly drained, a first strength component comprising anionic strength polymer and/or amphoteric strength polymer composition is applied on a surface of at least one fibrous web prior to joining the fibrous layers together. Preferably, a first strength component comprising anionic strength polymer and/or amphoteric strength polymer composition is applied on the surface of at least one layer the multi-layered board to be produced, which surface is arranged to be in contact with another layer of the multi-layered board to be produced. Additionally, according to the present invention, a cationic second strength component is added to the fibre stock of at least one of the fibrous layers joined together prior to forming fibrous layer from the fibre stock. The cationicity of the second strength component improves retention of the first strength component to the fibre layer, by forming ion bonds between the first and the second strength component. By using both the first strength component and the cationic second strength component it may be possible to obtain higher strength, such as z-directional tensile strength and/or burst strength and/or short span compression strength, than when using the strength components alone, even at elevated dosage. In an embodiment of the present invention, a first strength component is applied on a surface of the fibrous layer, which is formed form the fibre stock comprising added cationic second strength component, i.e. at least one fibrous layer of the multi-layered paperboard is treated by applying an aqueous solution of a first strength component in dissolved form comprising anionic strength polymer and/or amphoteric strength polymer composition on a surface of the layer and by adding an aqueous solution of a cationic second strength component in dissolved form to the fibre stock from which the layer is formed. In another embodiment of the present invention, a first strength component is applied on a surface of the fibrous layer, which is arranged to be contact with the layer which is formed form the fibre stock comprising added cationic second strength component.

According to the present invention, strength components are applied as aqueous solutions. Aqueous solution of the strength component in dissolved form means that at least 70 weight-% of the strength component dissolves with only some undissolved component present. For example, if the aqueous solution is fed through sieve having 100 μm openings and rinsed as required, at most 30 weight-% of the strength component in the aqueous solution remains on the sieve. The strength components are in dissolved form in the aqueous solutions. In a preferred embodiment according to the invention, a first strength component comprising anionic strength polymer and/or amphoteric strength polymer composition is hydrophilic, i.e. essentially void of hydrophobic group, for maximizing interactions based on ionic bonding and hydrogen bonding. More preferably, both of the strength components according to the present invention are water-soluble and hydrophilic.

According to the invention, a first strength component comprising anionic strength polymer and/or amphoteric strength polymer composition is applied on the surface of at least one fibrous layer and a cationic second strength component is added to the fibre stock, from which at least one of the fibrous layers joined together is formed. According to the invention, a first strength component comprising anionic strength polymer and/or amphoteric strength polymer composition and a cationic second strength component are preferably added to the same layer of the multi-layered paperboard.

According to an embodiment of the present invention, a first strength component comprises the anionic strength polymer comprising an anionic vinyl polymer, carboxymethyl cellulose (CMC) or any combination thereof. A weight average molecular weight of CMC is typically <2 000 000 g/mol. According to an embodiment of the invention, a weight average molecular weight of anionic vinyl polymer is <20 000 000 g/mol, preferably <5 000 000 g/mol or <1 000 000 g/mol. Further according to some embodiments of the present invention, a weight average molecular weight of CMC and anionic vinyl polymer is >50 000 g/mol, preferably >200 000 g/mol or >400 000 g/mol for enhancing interactions between polymers and fibres. Lower molecular weight of the polymers may favour binding with anionic trash, fillers and fines, while higher molecular weight enhances binding with fibres. A weight average molecular weight of an anionic vinyl polymer between 400 000-1 000 000 g/mol is especially effective since it provides good bonding with fillers and fines but also with long fibres.

According to another embodiment of the present invention, a first strength component comprises amphoteric strength polymer composition. Amphoteric strength polymer has ability to make ionic bonding between the polymers in the amphoteric composition. This self-crosslinking by ionic bonding allows the increase of the size for the polymer. Further advantage of the amphoteric polymer composition is that it may change the ionic charge if it is applied in different pH than the pH of the web. In comparison to a first strength component comprising the anionic strength polymer, pH of the amphoteric strength polymer composition may be advantageous for spraying e.g. due to lower viscosity, and in application pH the amphoteric polymer may have more ionic interactions with the web containing wet-end additives such as cationic starch. In an embodiment according to the invention, a first strength component comprises amphoteric strength polymer composition comprising amphoteric vinyl polymer, or a combination of anionic strength polymer(s) and cationic strength polymer(s). In the present invention, a first strength component comprising amphoteric strength polymer composition means that said composition has anionic and cationic charges present at pH 7. Preferably the amphoteric strength polymer composition has cationic charge of 0.1-2 meq/g (dry) at pH 2.7.

According to an embodiment of the invention the amphoteric strength polymer composition comprising amphoteric vinyl polymer, which comprises at least anionic monomer and cationic monomer, and optionally non-ionic monomer. According to an embodiment the amphoteric vinyl polymer comprises 2-20 mol-% and preferably 2-8 mol-% of anionic monomers, 0.5-18 mol-% and preferably 0.5-5 mol-% of cationic monomers, and 65-95 mol-%, preferably 85-95 mol-% of non-ionic monomers.

According to another embodiment of the invention the amphoteric strength polymer composition comprising a combination of anionic strength polymer(s) and cationic strength polymer(s). The combination of anionic strength polymer(s) and cationic strength polymer(s) may be in any form, for example polyion complex or mixture of the polymer(s). In the combination of anionic strength polymer (s) and cationic strength polymer(s), there may be ion bonds between the polymers, but the mixture of the polymer(s) may also comprise a blend of the polymer(s) without ion bonds between the components, as the ion bonds are dependent on the pH of the composition. According to an embodiment of the invention, the combination of anionic strength polymer(s) and cationic strength polymer(s) comprises anionic strength polymer comprising anionic vinyl polymer, carboxymethyl cellulose (CMC) or any combination thereof, and cationic strength polymer comprising cationic vinyl polymer, cationic starch, polyamine or any combination thereof. According to a preferred embodiment of the invention, a cationic polymer comprises at least vinyl monomers, such as acrylamide. Examples of cationic vinyl polymer include cationic polyacrylamides (CPAM), such as copolymers of acrylamide and at least one cationic vinyl monomer like diallyldimethyl-ammonium chloride (DADMAC) or [2-(acryloyloxy)ethyl] trimethylammonium chloride (ADAM-Cl); glyoxylated cationic vinyl polymers, such as glyoxylated polyDADMAC; polyvinylamines (PVAM), such as partially or fully hydrolysed poly-N-vinylformamides; cationic homopolymer(s) and any combinations thereof. Examples of polyamine include polyamidoamine, copolymer of dimethylamine and epichlorohydrin, copolymer of dimethylamine, epichlorohydrin and ethylenediamine, polyamidoamine epichlorohydrin, polyethyleneimine, and any combinations of these. In a combination of anionic strength polymer(s) and cationic strength polymer (s), the cationic strength polymer may be a cationic polymer, such as cationic starch. In an embodiment of the invention, the cationic polymer has a charge density of 0.2-3 meq/g (dry), and preferably 0.4-2 meq/g (dry), measured at pH 7. According to one embodiment of the invention the cationic starch used in the combination may have an average molecular weight MW in the range of 10 000 000-400 000 000 Da, preferably 50 000 000-400 000 000 Da, more preferably 100 000 000-400 000 000 Da. Cationic starch may be cationic non-degraded starch, which comprises amylopectin units. In one preferred embodiment according to the invention, a combination of anionic strength polymer(s) and cationic strength polymer(s) comprises anionic vinyl polymer as the anionic strength polymer and cationic starch as the cationic strength polymer. More preferably, a combination of anionic strength polymer(s) and cationic strength polymer(s) comprises acrylamide vinyl polymer and non-degraded cationic starch. For the sake of clarity, as aqueous solutions of the first strength component and the cationic second strength component, in dissolved form, are used, it is evident that granular starch even if comprising anionic and/or cationic charges, is not encompassed by expressions the first strength component and the cationic second strength component.

According to an embodiment of the invention a first strength component may comprise both anionic strength polymer and amphoteric strength polymer composition. Preferred polymers and compositions are same as disclosed more detailed above.

According to an embodiment of the invention, a viscosity of the anionic strength polymer or the amphoteric strength polymer composition may be in the range of 5-10 000 mPas, measured at 2 weight-% solids at pH 7 and 23° C. using Brookfield viscometer LVDV1 with small sample adapter using maximum rpm allowed by the equipment.

According to an embodiment of the invention, a first strength component comprising the anionic strength polymer and/or the amphoteric strength polymer composition has anionic net charge, at pH 7. According to an embodiment of the invention the first strength component has a net charge of −0.1--3.0 meq/g (dry), more preferably −0.2--1.0 meq/g (dry) at pH 7. While anionic net charge provides good interaction with the cationic second strength component and avoids over-cationization of the fibres or the white water, the net charges in the specified ranges facilitate broader dosage ranges, when using fibre stocks having typical zeta potential values such as −30 mV-0 mV, with a decreased risk of causing charge repulsion between the fibres and/or the fibrous layers. In an embodiment, a first strength component comprising the anionic strength polymer may have an anionic charge of 0.1-5 meq/g (dry), preferably 0.2-3.5 meq/g (dry), more preferably 0.5-3.5 meq/g (dry), at pH 7, for providing good interaction with the cationic second strength component. Higher anionicity may cause repulsion forces between the fibres. Net neutral charge may cause the collapsing of the polymer size, when cationic and anionic charges neutralize each other.

In an embodiment of the invention, a first strength component comprising the amphoteric strength polymer composition, preferably the amphoteric vinyl polymer or the combination of anionic strength polymer(s) and cationic strength polymer(s), may have a charge density of −3.5 meq/g-+1.0 meq/g (dry), preferably −2.5 meq/g--0.1 meq/g (dry), more preferably −2 meq/g--0.5 meq/g (dry), at pH 7. Preferably, a first strength component comprising the amphoteric strength polymer composition has a net charge at the pH of the aqueous composition to be applied, less than −0.1 meq/g (dry) or more than +0.1 meq/g (dry), in order to avoid gelling of the amphoteric strength polymer composition.

According to an embodiment of the present invention, an aqueous solution of the cationic second strength component with cationic charges at pH 7 may be added to a fibre stock from which at least one of the fibrous layers joined together is formed. The second strength component to be added to the fibre stock may comprise cationic strength polymer comprising cationic starch and/or synthetic cationic strength polymer(s), such as cationic vinyl polymer(s) such as cationic polyacrylamide (CPAM), glyoxylated cationic vinyl polymers, such as glyoxylated cationic polyacrylamide (GPAM), polyvinylamines (PVAM) such as partially or fully hydrolysed poly-N-vinylformamides, or cationic condensation polymer(s), such as polyethyleneimine (PEI) or polyamidoamine epichlorohydrin (PAE). In one preferred embodiment, the second strength component comprises cationic starch and/or cationic vinyl polymer, more preferably cationic starch is used as the second strength component. The cationic starch may be non-degraded cooked starch, typically having cationic degree of substitution DS 0.015-0.06. Preferably the cationic starch is potato, corn or tapioca starch. The synthetic cationic strength polymer may have an average molecular weight MW in the range of 400 000-3 000 000 Da. Molecular weight may be measured e.g. by GPC SEC polyethyleneoxide PEO calibration. Preferably, the synthetic cationic strength polymer may have charge density of 0.5-4 meq/g (dry), preferably 0.5-2.5 meq/g (dry), more preferably 0.6-1.8 meq/g (dry), at pH 7. These charge densities of the synthetic cationic strength polymer may provide good interaction with the first strength component and desired strength properties with substantially small dosage amounts.

According to an embodiment of the invention a first strength component and a second cationic strength component may be applied in such manner that a ratio of "the added charges, as measured at pH 7 of the first strength component" to "the added charges, as measured at pH 7 of the second cationic strength component", added to the one layer of the multi-layered paperboard, is in a range of 0.05:1-2:1, preferably 0.3:1-1:1. In this way good interactions between the first strength component and the cationic second strength component are obtainable providing enhanced strength effect, yet avoiding excessive dosages of the components.

According to the invention, an aqueous solution of the first strength component is applied on the surface of at least one fibrous layer. In one preferred embodiment of the invention, an aqueous solution of the first strength component is applied on the surface of at least one fibrous layer in combination with granular starch. Preferably, the first strength component is applied on the surface of at least one fibrous layer in combination with granular non-ionic, non-degraded or non-degraded non-ionic starch. The application with granular starch improves adhesion of the polymer component to the fibrous layer, such as fibrous web. When using both granular starch and the first strength component, the strength is generated both by hydrogen bond formation once the applied granular starch has been gelatinized, and ionic bond formation by the charged species, that do not compete with each other for bonding sites, but are complementary. Additionally, granular starch is mobile and may penetrate to the layers at the low web dryness, and this can be decreased by the presence of the first strength component by increasing the viscosity of the applied solution. By granular starch is meant starch that is capable of being gelatinized when heated above its gelatinization temperature. When applied to the layer, granular starch is not in its gelatinized form. Gelatinization of granular starch may be achieved for example when the moist multi-layered web comprising granular starch is dried in drying section. Typically, granular starch is uncooked starch. Granular starch may be chemically modified, for example comprising anionic and/or cationic charged groups. In some embodiments the granular starch is essentially non-ionic, to reduce or avoid complex formation between the granular starch and the first strength component when carrying opposite charges. Essentially non-ionic means that it has not been anionically or cationically derivatized but may naturally contain residual amounts of anionic and/or cationic charges. In some embodiments the granular starch is essentially non-degraded starch, as that may be more resistant towards premature gelatinization for example when the application temperature is slightly elevated. Essentially non-degraded means that it has not been subjected to a degradation unit process but may have undergone partial degradation during another unit process, such as during chemical modification. More preferably the granular starch is non-degraded non-ionic starch. According to an embodiment of the invention, a concentration of granular starch, such as granular non-ionic, non-degraded, or non-degraded non-ionic starch, may be in the range of 0.1-30 weight-%, preferably 1-8 weigh-%, and more preferably 1-6 weight-%, calculated from the aqueous solution, in the solution.

According to an embodiment of the invention, the first strength component and the granular starch are applied on a surface of the paperboard in a weight ratio of 0.02:1 to 3:1 (dry/dry), preferably 0.05:1 to 0.9:1 (dry/dry) and more preferably 0.1:1-0.4:1 (dry/dry).

A typical aqueous composition to be applied on the surface of the fibrous layer has a viscosity of below 100 mPas, typically the viscosity is in the range of 1.4-100 mPas, preferably 1.4-50 mPas and more preferably 2-30 mPas or 2-15 mPas measured by Brookfield LV DV1 viscometer with small sample adapter using maximum rpm allowed by the equipment, instantly after mixing, at prevailing temperature and solids content at the application time, and comprises

- a first strength component in dissolved form comprising anionic strength polymer and/or amphoteric strength polymer composition, and
- granular starch, preferably granular non-ionic, non-degraded or non-degraded non-ionic starch, wherein the weight ratio of the first strength component to granular starch is 0.02:1 to 3:1 (dry/dry), preferably 0.05:1 to 0.9:1 (dry/dry) and more preferably 0.1:1-0.4:1 (dry/dry). The prevailing temperature and solids content at the application time refers to the prevailing conditions present at time when said aqueous solution is applied on the surface of the fibrous layer.

According to an embodiment of the invention, the aqueous composition to be applied on the surface of the fibrous layer has a viscosity of below 100 mPas, typically the viscosity is in the range of 1.4-100 mPas, preferably 1.4-50 mPas and more preferably 2-30 mPas or 2-15 mPas measured by Brookfield LV DV1 viscometer with small sample adapter using maximum rpm allowed by the equipment, instantly after mixing, at prevailing temperature and solids content at the application time, and comprises the first strength component comprising anionic strength polymer, which comprises an anionic vinyl polymer, carboxymethyl cellulose or any combination thereof.

According to another embodiment of the invention, the aqueous composition to be applied on the surface of the fibrous layer has a viscosity of below 100 mPas, typically the viscosity is in the range of 1.4-100 mPas, preferably 1.4-50 mPas and more preferably 2-30 mPas or 2-15 mPas measured by Brookfield LV DV1 viscometer with small sample adapter using maximum rpm allowed by the equipment, instantly after mixing, at prevailing temperature and solids content at the application time, and comprises the first strength component comprising an amphoteric strength polymer composition comprising amphoteric vinyl polymers, or a combination of anionic strength polymers(s) and cationic strength polymer(s), wherein the combination may comprise anionic strength polymer comprising anionic vinyl polymer, carboxymethyl cellulose or any combination thereof, and cationic strength polymer comprising cationic vinyl polymer, cationic starch, polyamine or any combination thereof. According to an embodiment of the invention, the aqueous composition to be applied on the surface of the fibrous layer comprises the first strength component comprising both anionic strength polymer and an amphoteric strength polymer composition. According to an embodiment of the invention, the aqueous composition to be applied on the surface of the fibrous layer comprises granular starch in concentration of 0.1-30 weight-%, preferably 1-8 weight-%, calculated from the aqueous composition. The aqueous composition has net anionic charge, measured at pH 7.

In one preferred embodiment according to the invention, an aqueous solution comprising the first strength component comprising anionic strength polymer and/or amphoteric strength polymer composition and optionally granular starch is applied on the surface of at least one fibrous layer by spraying or by foam layer application. In a preferred embodiment of the invention, an aqueous solution comprising the first strength component and optionally granular starch is applied on the surface of at least one fibrous layer by spraying. Therefore, a viscosity of an aqueous solution comprising the first strength component comprising anionic strength polymer and/or amphoteric strength polymer composition and optionally granular starch should be applicable to the spraying. Further, an application temperature should be appropriate in order for eliminating gelatinization of the starch during spraying. According to the invention, an application temperature of an aqueous solution comprising the first strength component comprising anionic strength polymer and/or amphoteric strength polymer composition, and optionally granular starch, is typically about 20° C. The application temperature may be in the range of 5-60° C. or 20-40° C.

According to a typical embodiment of the invention, a pH of an aqueous solution comprising the first strength component comprising anionic strength polymer and/or amphoteric strength polymer composition is about 3-5, such as 4-4.5, when the aqueous solution is applied to a surface of the fibrous layer. The pH of the fibrous layer or web is typically between 6 and 9, such as about 7. Therefore, especially when an aqueous solution of first strength component comprising amphoteric strength polymer composition having a lower pH than pH of the fibre suspension, at least part of the anionic charges of the amphoteric component will form just on the surface of the fibrous layer. This provides e.g. that the aqueous solution can be applied in lower viscosity and after application, complex structure of the amphoteric polymer may be formed in consequence of the pH change and so it retains better to the surface of the fibrous layer.

According to the present invention, a first strength component comprising anionic strength polymer and/or amphoteric strength polymer composition is applied on a surface of at least one fibrous layer prior to joining fibrous layers together. An application of the first strength component is preferably carried out just prior to joining fibrous layers, but the application may be arranged at any point between the forming unit and the joining arrangement of the fibrous layers. Preferably, a first strength component is applied on the surface(s) of the inner layer(s) of the multi-layered board to be produced. The first strength component may be applied only some of the inner layers or it may be applied all the inners layers of the multi-layered board to be produced. According to one embodiment of the invention, the inner layer is ply or plies between the top ply and back ply. According to one preferred embodiment of the invention, the first strength component is applied on one surface of the fibrous layer of the multi-layered board. Typically, the surface is the surface of the layer which may affect mostly to possible delamination. In an embodiment, the first strength component is applied on the surface of the layer which is in the middle of the final multi-layered board when calculated in relation to the grammage of the board. The dryness of the fibrous layers at the time of applying the first strength component, and optionally the granular starch, may be 0.5-25%, preferably 1.5-20% and more preferably 2-18% and even more preferably 10-15% to avoid too much penetration of the applied strength component and to still facilitate joining of the fibrous layers after the application. Joining at higher dryness may result in insufficient fibre-fibre bond formation and thus lower z-directional tensile strength. The water applied together with the strength component may further improve fibre-fibre bond formation at the joining.

When layers of the multi-layered board have been produced from the fibre stocks comprising different characteristics, the desired internal bond strength between the layers might be a problem. In an embodiment of the invention, a first strength component may be applied on the surface of the layer, which layer has produced from fibre stock having the highest freeness value in the multi-layered board, when measured from thick stock dosed to the approach flow of the forming unit. This applies also for 2-ply board. Preferably, freeness is >200 ml, >400 ml, even >550 ml at the layer, where first strength component is applied.

In some embodiments, a first strength component may be applied on the surface of the layer, which layer has the highest bulk value in the multi-layered board, when measured from a hand sheet made from thick stock dosed to the approach flow of the forming unit. Bulk value is determined in a handsheet made of thick stock according to standard method. This applies also for 2-ply board. Preferably bulk is >1.5, >2.0, even >3, determined by Rapid Köchen sheet former used according to method in accordance with ISO 5269-2:2012.

An amount of the first strength component to be applied on the surface of the fibrous layer is dependent on e.g. the composition of the first strength component, fibre stock and the required characteristics of the multi-layered board to be produced. In a typical embodiment of the invention, a first strength component may be applied on one surface of the fibrous layer in an amount of 0.02-1.0 g/m$^3$, preferably 0.05-0.5 g/m$^2$, and more preferably 0.08-0.3 g/m$^2$. If an aqueous solution of the first strength component also comprises granular starch, the starch is typically applied on one surface of the fibrous layer in an amount of 0.05-3 g/m$^2$.

A cationic second strength component may be added to a fibre stock in an amount of 2-25 kg/ton of fibre stock as dry in case of cationic starch, or 0.7-5 kg/ton of fibre stock as dry in case of synthetic cationic strength polymer. A second strength component may be added to thin stock or thick stock. In a preferred embodiment the second strength component is added to the thick stock. Thick stock is here understood as a fibrous stock or furnish, which has consistency of at least 20 g/l, preferably more than 25 g/l, more preferably more than 30 g/l. According to one embodiment, the addition of the second strength component is located after the stock storage towers, but before thick stock is diluted. In the present context, the term "fibre stock" is understood as an aqueous suspension, which comprises fibres and optionally fillers. A fibre stock may comprise recycled fibre material and/or broke. A fibre stock may be old corrugated container (OCC) pulp or mixed waste. A fibre stock may also be chemi-thermomechanical pulp (CTMP) or mechanical pulp, such as thermomechanical pulp (TMP), pressurized groundwood (PGW), alkaline peroxide mechanical pulp (APMP) or stone groundwood (SGW).

According to the present invention a multi-layered paperboard may be any multi-layered paperboard, which comprises at least two fibrous layers and is produced by using a method according to the present invention. The invention is particularly advantageously implemented when forming folding boxboard, liquid packing board, white top liner, kraft liner, test liner, fluting, gypsum board, chipboard, core board, cupboard, or white lined chipboard. However, the invention also can be implemented when forming other paper or paperboard webs comprising at least two layers. According to an embodiment of the invention a multi-layered board or paper refers also to packaging papers. In some embodiments of the invention, the paperboard further comprises a coating containing mineral pigments, and offset printing.

Thick multi-layered paperboards benefit most from the manufacturing method according to the present invention, because the thick boards may need to be formed from multiple plies to maintain desired manufacturing speed, such as >300 m/min and so the z-directional tensile strength of the board may become a problem. According to one preferred embodiment of the invention, a multi-layered board may have total thickness of more than 100 μm or more than 150 μm and preferably more than 200 μm.

A better understanding of the present invention may be obtained through the following examples which are set worth to illustrate but are not to be construed as the limit of the present invention.

EXPERIMENTAL

Example 1

This example simulates preparation of multi-layered paperboard, such as liner board, white lined chipboard or core board. Test sheets were made with Formette-dynamic hand sheet former manufactured by Techpap.

Test fibre stock was made to simulate recycled fibre. Central European testliner board was used as raw-material. This testliner contains about 17 ash and 5% surface size starch. Dilution water was made from tap water by adjusting $Ca^{2+}$ concentration to 520 mg/l by $CaCl_2$) and by adjusting conductivity to 4 mS/cm by NaCl. Testliner board was cut to 2*2 cm squares. 2.7 l of dilution water was heated to 70° C. The pieces of testliner was wetted for 10 minutes in dilution water at 2% concentration before disintegration. Slurry was disintegrated in Britt jar disintegrator with 30 000 rotations. Pulp was diluted to 0.6% by adding dilution water. Test chemicals were prepared according to Table 1.

Test fibre stock was added to dynamic hand sheet former Formette by Techpap. Chemical additions were made to mixing tank of Formette according to Table 2. All chemical amounts are given as kg dry chemical per ton dry fibre stock. Test was made at room temperature. Drum was operated with 1000 rpm, mixer for pulp 400 rpm, pulp pump 1100 rpm/min, all the pulp was sprayed. Back ply of 50 g/m$^2$ was formed first then spray layer consisting 2 litres water, granular starch and test chemical and finally top ply of 50 g/m$^2$. Web concentration was about 1%, when starch and test chemical was sprayed between the plies. Typically, concentrations are lower in laboratory equipment compared to board machine to make uniform quality and repeatable results. All the water was drained at the end. Scoop time was 60 s. Sheet was removed from drum between wire and 1 blotting paper on the other side of the sheet. Wetted blotting paper and wire were removed. Sheets were wet pressed at Techpap nip press with 4.5 bar pressure with 2 passes having new blotting paper each side of the sheet before each pass. Sheets were cut to 15 cm*20 cm size. Sheets were dried in restrained condition in STFI restrained dryers 10 min at 130° C. Before testing in the laboratory sheets were pre-conditioned for 24 h at 23° C. in 50% relative humidity, according to ISO 187. Z-directional tensile (ZDT) was measured according to ISO 15754. Short span compression strength (SCT) was measured in cross direction (CD) according to ISO 9895. Bursting strength (Burst) was measured according to Tappi T 569.

TABLE 1

Test chemicals. (Mw = weight average molecular weight)

| Sample | Composition | Properties | Preparation |
|---|---|---|---|
| C-Starch | Cationic potato starch | cationic substitution DS 0.035, non-degraded | 30 min cooking at 97° C. at 1% concentration |
| G-Starch | Cationic potato starch | cationic substitution DS 0.016, non-degraded | 5% slurry was made by mixing at 23° C. |
| N-Starch | Corn Starch | native, non-degraded | 5% slurry was made by mixing at 23° C. |
| CPAM | 10 mol-% cationic polyacrylamide | Mw 6M g/mol | Dissolving at 0.5% conc. 60 min, dilution to 0.05% conc. |
| silica | Structured aluminated silica sol | | Diluted to 0.5% |
| COMP-1 | combination of cationic starch and APAM-2 | net charge −0.65 meq/g (dry) at pH 7 | Components are mixed as 3% conc. solutions and diluted to 1% conc. |
| COMP-2 | combination of cationic starch and CMC-1 | net charge −1.4 meq/g (dry) at pH 7 | components are mixed as 1% conc. solutions. |
| CMC-1 | CMC | Mw ~300 000 g/mol, DS about 0.7 | dissolved in 50° C. at 1% conc. for 60 min |
| CMC-2 | CMC | Mw 400 000 g/mol, DS 0.4 | dissolved in 50° C. at 1% conc. for 60 min. |
| APAM | anionic polyacrylamide | 8 mol-% acrylic acid, Mw 450 000 g/mol | diluted to 1% conc. |
| APAM-2 | anionic polyacrylamide | 11 mol-% acrylic acid, Mw 600 000 | diluted to 1% conc. |

TABLE 1-continued

| Test chemicals. (Mw = weight average molecular weight) | | | |
|---|---|---|---|
| Sample | Composition | Properties | Preparation |
| | | g/mol | |
| AMF-2 | combination of anionic polyacrylamide and cationic polyacrylamide | Net charge −0.2 meq/g (dry) at pH 7, Mw 100000-500000 g/mol | diluted to 2% conc. |
| AMF-4 | combination of anionic polyacrylamide and cationic polyacrylamide | Net charge 0.2 meq/g (dry) at pH 7, Mw 100000-500000 g/mol | diluted to 2% conc. |
| AMF-8 | combination of anionic polyacrylamide and cationic starch | Net charge −0.9 meq/g (dry) at pH 7, Mw ~600 000 g/mol | diluted to 2% conc. |
| AMF-9 | combination of anionic polyacrylamide and cationic starch | Net charge −0.9 meq/g (dry) at pH 7, Mw ~500 000 g/mol | diluted to 2% conc. |

TABLE 2

| Chemical additions. | | | | | | | | | |
|---|---|---|---|---|---|---|---|---|---|
| layer | | | | | | | | | |
| | Top&Back | Top&Back | Top&Back | Spray | Spray | Spray | Spray | Spray | Spray |
| time, s | | | | | | | | | |
| | −30 | −20 | −10 | −40 | −15 | −15 | −15 | −15 | −15 |
| Test | | | | | | | | | |
| | C-Starch kg/t dry | CPAM kg/t dry | Silica kg/t dry | N-starch kg/t dry | COMP-1 kg/t dry | COMP-2 kg/t dry | APAM kg/t dry | CMC-2 kg/t dry | CMC-1 kg/t dry |
| 1 | | 0.1 | 0.15 | 3 | | | | | |
| 2 | 5 | 0.1 | 0.15 | 3 | 1.5 | | | | |
| 3 | 5 | 0.1 | 0.15 | 3 | | 1.5 | | | |
| 4 | 5 | 0.1 | 0.15 | 3 | | | 1.5 | | |
| 5 | 5 | 0.1 | 0.15 | 3 | | | | 1.5 | |
| 6 | 5 | 0.1 | 0.15 | 3 | | | | | 1.5 |

Strength results of dynamic hand sheets are presented at Table 3. Test 1 was reference and test points 2-6 were according to invention. All the strength properties were improved compared to reference. Higher molecular weight of the composition improved ZDT most. Viscosity of spray slurry is limiting the dosage or the molecular weight of linear polymer used in the spray composition. On the other hand, it is not feasible to lower the solids content of the aqueous composition to be applied, to avoid risk of web breakage and to reduce need for additional drainage capacity. Molecular weight has also affect to the rheology of the spray slurry penetrating to the wet fibrous web. It would be beneficial for ZDT, if native starch is retained to the fibrous web between the plies and not going through the sheet structure, which may be controlled by the viscosity of the aqueous composition comprising the granular starch. SCT and burst strength are important for liner board. All three strength parameters are needed for manufacturing of white top liner.

Table 4 shows how the first strength component influences the viscosity. Viscosities were measure with Brookfield LV DV1 viscometer with small sample adapter, using maximum rpm allowed by the equipment, instantly from the mixed slurries to avoid sedimentation of the starch granules. To achieve even spraying result the viscosities should be low enough e.g. <100 mPas. To improve the retention of granular starch and to bond the granular starch between the plies it is beneficial that viscosity is elevated from the level obtained with granular starch slurry.

TABLE 3

| Strength measurements. | | | |
|---|---|---|---|
| Test | ZDT [kPa] | Burst [kPa] | SCT (CD) [kN/m] |
| 1 | 427 | 228 | 1.63 |
| 2 | 606 | 259 | 1.71 |
| 3 | 557 | 240 | 1.69 |
| 4 | 579 | 255 | 1.72 |
| 5 | 618 | 246 | 1.78 |
| 6 | 583 | 250 | 1.72 |

TABLE 4

Viscosity of aqueous composition comprising granular starch and first strength component.

| Test | first strength component, % of dry | granular starch, % of dry | total concentration, % dry | viscosity, mPas at 23° C. |
|---|---|---|---|---|
| 1 | — | N-starch 100% | 5% | 1.8 |
| 2 | COMP-1 33% | N-starch 67% | 5% | 8.2 |
| 3 | APAM 33% | N-starch 67% | 5% | 9.7 |
| 4 | CMC-1 33% | N-starch 67% | 5% | 6.3 |
| 5 | CMC-2 33% | N-starch 67% | 5% | 26 |
| 6 | AMF-2 33% | N-starch 67% | 5% | 6.9 |
| 7 | AMF-4 33% | N-starch 67% | 5% | 12 |
| 8 | — | G-starch 100% | 4% | 1.1 |
| 9 | — | G-starch 100% | 4.5% | 1.2 |
| 10 | — | G-starch 100% | 5% | 1.3 |
| 11 | AMF-8 10% | G-starch 90% | 5% | 2.6 |
| 12 | AMF-8 20% | G-starch 80% | 5% | 3.7 |
| 13 | AMF-9 10% | G-starch 90% | 5% | 1.6 |
| 14 | AMF-9 20% | G-starch 80% | 5% | 2.3 |
| 15 | AMF-9 40% | G-starch 60% | 5% | 3.6 |
| 16 | APAM 10% | G-starch 90% | 5% | 2.8 |
| 17 | APAM 20% | G-starch 80% | 5% | 4.9 |
| 18 | APAM-2 10% | G-starch 90% | 5% | 4.3 |
| 19 | APAM-2 20% | G-starch 80% | 5% | 8.5 |
| 20 | COMP-1 10% | G-starch 90% | 5% | 1.6 |
| 21 | COMP-1 20% | G-starch 80% | 5% | 4.0 |

Example 2

Figure 2:
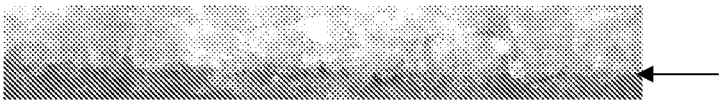
FIG. 2 is a reference microscope image of a multi-layered fibre web where aqueous solution of granular starch has been applied between the layers.

In this Example, Light microscopy images (width 1 mm, height 0.1 mm) were taken from iodine solution colored cross directionally cut sheet. FIG. 1 presents a microscope image of a multi-layered paperboard where an aqueous composition according to the invention has been applied between layers, and FIG. 2 presents a reference microscope image of a multi-layered paperboard where aqueous solution of granular starch has been applied between the layers. The images include middle ply and back ply of a multi-layered paperboard. Back ply (wire side) of the multi-layered paperboard is bottom side in picture. The bond line between the middle ply and back ply has pointed by arrow in the Figures. Top and back ply pulps were bleached kraft pulps refined to SR 25, and middle ply pulp was bleached CTMP refined to 440 ml CSF, and broke was disintegrated from sheets of folding boxboard equal to furnish of this test.

The multi-layered paperboards were made by using dynamic handsheet former. The sheet preparation cycle was completed according to example 1. The multilayered paperboard has the following composition presented in Table 5.

TABLE 5

| Layer | Basis weight | Furnish |
|---|---|---|
| top ply | 35 g/m$^2$ | pine/birch, 20/80 |
| spray 1 | 0.8 g/m$^2$ | native corn starch |
| middle ply | 155 g/m$^2$ | CTMP/broke, 80/20 |
| spray 2 | 0.8 g/m$^2$ | native corn starch |
| back ply | 35 g/m$^2$ | pine/birch, 20/80 |

In addition, cationic cooked starch 5 kg/t was added to top, middle and back ply pulps. In the reference case of FIG. 2, only granular native starch 0.8 g/m$^2$ has been applied between the layers by spraying (i.e not any polymers in combination with the granular starch). In the case of FIG. 1, granular native starch 0.8 g/m$^2$ and amphoteric strength polymer composition 0.4 g/m$^2$ have been applied between the layers by spraying.

From FIGS. 1 and 2, it can be seen that more iodine stained starch granules (dark spots) are between the plies when using the method according to the invention. The starch granules hold on the bond line between the layers when using the amphoteric strength polymer composition according to the present invention as shown in FIG. 1, whereas in the reference FIG. 2 starch granules have been washed out with the removed water.

The invention claimed is:

1. A method for manufacturing a multi-layered paperboard comprising at least two fibrous layers formed by multiple separate forming units, the method comprising steps of:

draining at least part of water from at least one of the at least two fibrous layers;

treating the at least one of the at least two fibrous layers by applying an aqueous solution of a first strength component in dissolved form on a surface of the at least one of the at least two fibrous layers when dryness of the layer to be treated is 2-18%, wherein the first strength component comprises anionic strength polymer and/or amphoteric strength polymer composition having a net charge of −0.1--3.0 meq/g (dry) at pH 7, and the aqueous solution of the first strength component has a viscosity of 1.4-100 mPas instantly after mixing when measured by Brookfield LV DV1 viscometer with small sample adapter using maximum rpm allowed by the viscometer at prevailing temperature and solids content at the application time;

adding an aqueous solution of a cationic second strength component in dissolved form to a fibre stock from which at least one of the at least two fibrous layers is formed, wherein the cationic second strength component comprises cationic starch having cationic degree of substitution of 0.015-0.06, and/or synthetic cationic strength polymer having weight-average molecular weight of 400 000-3 000 000 Da and charge density of 0-5-4 meq/g (dry), at pH; and arranging the surface treated with the first strength component to be in contact with another fibrous layer to join the layers together, and subjecting the joined layers to further draining, wet pressing and drying to obtain the multi-layered paperboard product.

2. The method according to claim 1, wherein the first strength component comprises anionic strength polymer comprising an anionic vinyl polymer, carboxymethyl cellulose or any combination thereof.

3. The method according to claim 1, wherein the first strength component comprises amphoteric strength polymer composition comprising amphoteric vinyl polymer, or a combination of anionic strength polymer(s) and cationic strength polymer(s).

4. The method according to claim 3, wherein the combination of anionic strength polymer(s) and cationic strength polymer(s) comprises:

anionic strength polymer comprising anionic vinyl polymer, carboxymethyl cellulose or any combination thereof, and cationic strength polymer comprising cationic vinyl polymer, cationic starch, polyamine or any combination thereof.

5. The method according to claim 1, wherein the first strength component has a net charge of −0.2--1.0 meq/g (dry) at pH 7.

6. The method according to claim 1, wherein the first strength component comprising the anionic strength polymer has an anionic charge of 0.1-5 meq/g (dry) at pH 7.

7. The method according to claim 1, wherein the first strength component comprising anionic strength polymer and/or amphoteric strength polymer composition is hydrophilic.

8. The method according to claim 1, wherein the aqueous solution of the first strength component is applied on the surface of the layer by spraying or by foam layer application.

9. The method according to claim 1, wherein the aqueous solution of the first strength component is applied on the surface of the fibrous layer in combination with a granular starch.

10. The method according to claim 9, wherein the first strength component and the granular starch are applied in a weight ratio of 0.02:1 to 3:1 (dry/dry).

11. The method according to claim 1, wherein the first strength component and the cationic second strength component are applied in such manner that a ratio of "the added charges, as measured at pH 7 of the first strength component" to "the added charges, as measured at pH 7 of the cationic second strength component" is in a range of 0.05:1-2:1.

12. The method according to claim 1, wherein the first strength component is applied on the surface of the layer, which layer has been produced from fibre stock having highest freeness value in the multi-layered paperboard, when measured from thick stock dosed to an approach flow of the forming unit.

13. The method according to claim 1, wherein the first strength component is applied on the surface of the layer, which layer has the highest bulk value in the multi-layered paperboard, when measured from a hand sheet made from thick stock dosed to an approach flow of the forming unit.

14. The method according to claim 1, wherein the first strength component is applied on at least one surface of the layer in an amount of 0.02-1.0 g (dry)/$m^2$.

15. The method according to claim 1, wherein the cationic second strength component is added in an amount of 2-25 kg/ton of fibre stock as dry in case of cationic starch, or 0.7-5 kg/ton of fibre stock as dry in case of synthetic cationic strength polymer.

* * * * *